US010677476B2

(12) United States Patent
Kim et al.

(10) Patent No.: US 10,677,476 B2
(45) Date of Patent: Jun. 9, 2020

(54) AIR CONDITIONER

(71) Applicant: Samsung Electronics Co., Ltd, Gyeonggi-do (KR)

(72) Inventors: Jung Ho Kim, Gyeonggi-do (KR); Yong Hyun Kil, Gyeonggi-do (KR); Young Sun Shin, Seoul (KR); Sung June Cho, Gyeonggi-do (KR); Hee Jae Jeong, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 596 days.

(21) Appl. No.: 15/317,850

(22) PCT Filed: Jun. 3, 2015

(86) PCT No.: PCT/KR2015/005575
§ 371 (c)(1),
(2) Date: Dec. 9, 2016

(87) PCT Pub. No.: WO2015/190740
PCT Pub. Date: Dec. 17, 2015

(65) Prior Publication Data

US 2017/0138617 A1 May 18, 2017

(30) Foreign Application Priority Data

Jun. 9, 2014 (KR) ..... 10-2014-0069726

(51) Int. Cl.
*F24F 1/022* (2019.01)
*F24F 13/20* (2006.01)

(52) U.S. Cl.
CPC ..... *F24F 1/022* (2013.01); *F24F 13/20* (2013.01); *F24F 2221/17* (2013.01); *F24F 2221/26* (2013.01); *F24F 2221/38* (2013.01)

(58) Field of Classification Search
CPC ..... F24F 13/20; F24F 1/022; F24F 2221/17; F24F 2221/26; F24F 2221/38
See application file for complete search history.

(56) References Cited

U.S. PATENT DOCUMENTS 3,324,677 A 6/1967 Brown
3,742,725 A 7/1973 Berger
(Continued)

FOREIGN PATENT DOCUMENTS

CN 1668878 A 9/2005
EP 2116785 A1 11/2009
(Continued)

OTHER PUBLICATIONS

International Search Report dated Sep. 11, 2015 in connection with International Application No. PCT/KR2015/005575, 3 pages.
(Continued)

*Primary Examiner* — Henry T Crenshaw

(57) ABSTRACT

An air conditioner according to the present invention includes a main body in which a compressor for compressing a refrigerant, a condenser for condensing the refrigerant compressed by the compressor into a liquid phase, an expansion device for expanding the refrigerant condensed by the condenser into a refrigerant in a low pressure state, and an evaporator for exchanging heat with surroundings by evaporating the refrigerant in a low temperature and low pressure state are arranged, a first discharge port that is provided in the main body and discharges air heat-exchanged with the condenser to an air-conditioned space, and a second discharge port that is provided in the main body and discharges air heat-exchanged with the evaporator to the air-conditioned space. Through this structure, it is possible to perform intensive air conditioning with respect to a
(Continued)

predetermined area of an air-conditioned space, and attain miniaturization of the air conditioner.

7 Claims, 17 Drawing Sheets

(56) References Cited

U.S. PATENT DOCUMENTS

| | | | | |
|---|---|---|---|---|
| 6,425,255 | B1 * | 7/2002 | Hoffman | A47C 21/044 62/261 |
| 7,603,873 | B2 | 10/2009 | Tonin | |
| 2008/0000251 | A1 * | 1/2008 | Lee | F24F 13/20 62/291 |
| 2008/0034770 | A1 * | 2/2008 | Al-Azmi | F24F 5/0096 62/199 |
| 2013/0133351 | A1 * | 5/2013 | Kil | F24F 13/222 62/291 |
| 2013/0143480 | A1 * | 6/2013 | Trevelyan | A47C 21/044 454/284 |
| 2014/0150488 | A1 * | 6/2014 | Black | F24F 3/14 62/404 |
| 2014/0232022 | A1 * | 8/2014 | Chung | F24F 6/12 261/78.1 |
| 2014/0290301 | A1 * | 10/2014 | Law | F24F 5/0042 62/404 |
| 2014/0361101 | A1 * | 12/2014 | Maher | F24F 6/14 239/302 |
| 2015/0084215 | A1 * | 3/2015 | Ojeda | F24F 6/043 261/71 |
| 2015/0090429 | A1 * | 4/2015 | Jeong | F24F 13/20 165/121 |

FOREIGN PATENT DOCUMENTS

| | | |
|---|---|---|
| JP | 0914692 | 1/1997 |
| KR | 10-2004-0050560 A | 6/2004 |
| KR | 1020050048868 | 5/2005 |
| KR | 1020050102065 | 10/2005 |
| KR | 1020080065176 | 7/2008 |
| KR | 10-2009-0028856 A | 3/2009 |
| KR | 2020090008974 | 9/2009 |

OTHER PUBLICATIONS

Written Opinion of the International Searching Authority dated Sep. 11, 2015 in connection with International Application No. PCT/KR2015/005575, 11 pages.

Extended European Search Report, dated Nov. 17, 2017, regarding Application No. 15805892.5, 7 pages.

Office Action dated Oct. 23, 2018 in connection with Chinese Patent Application No. 201580030380.6, 14 pages.

Office Action dated Jun. 13, 2019 in connection with Chinese Patent Application No. 201580030380.6, 12 pages.

National Intellectual Property Administration, PRC, "Decision of Rejection," Application No. CN201580030380.6, Sep. 30, 2019, 18 pages.

* cited by examiner

[Fig. 1a]
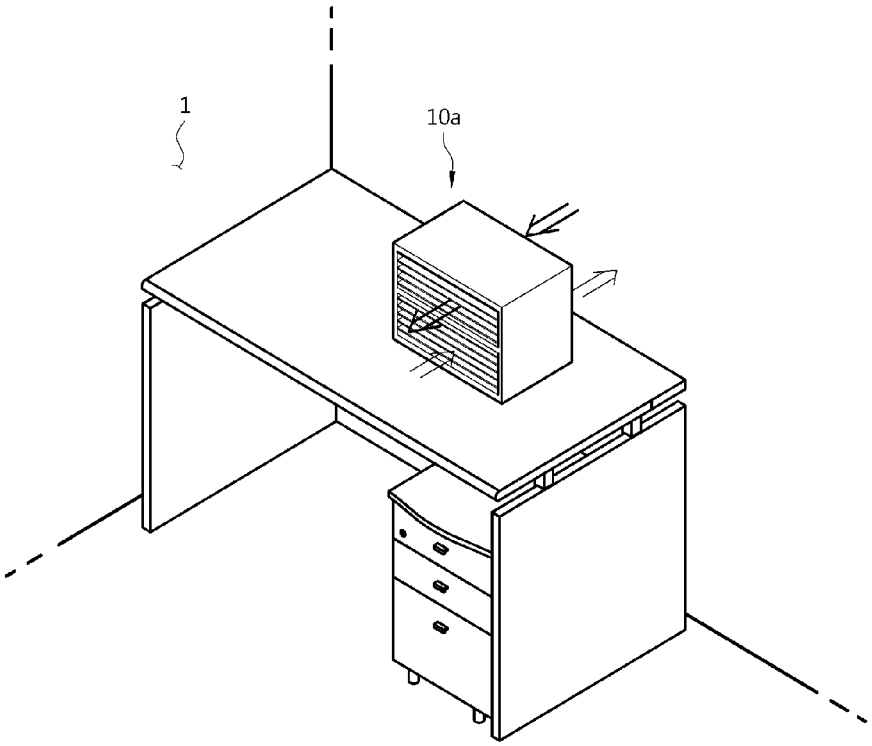

[Fig. 1b]
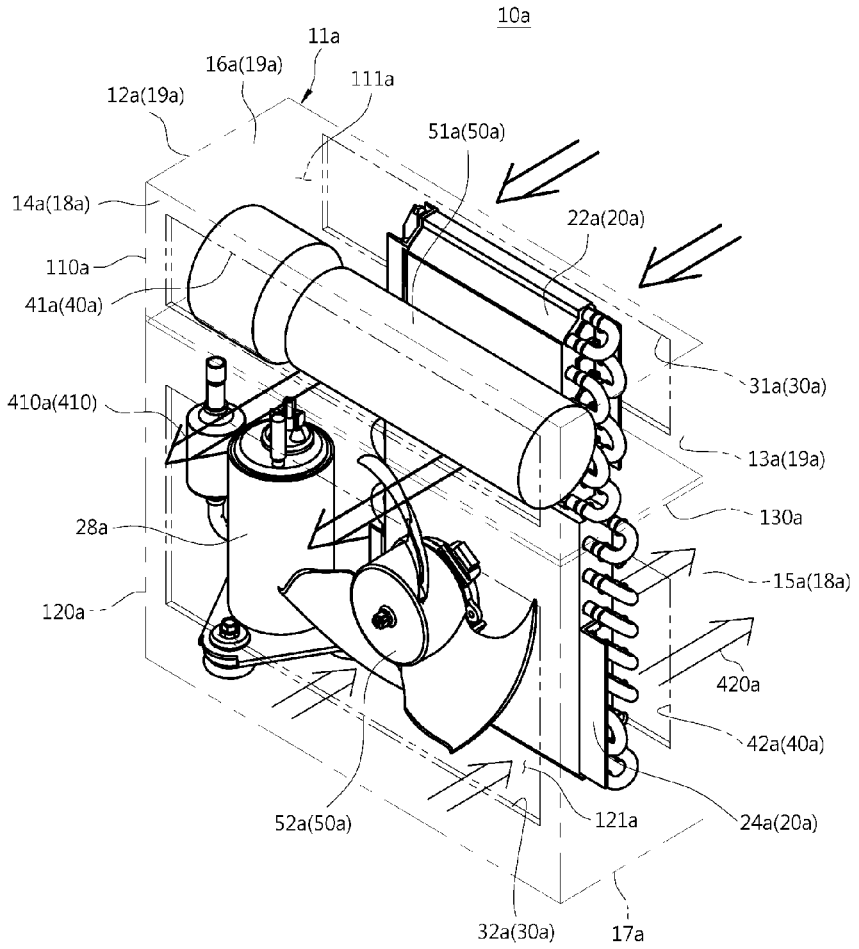

[Fig. 2]
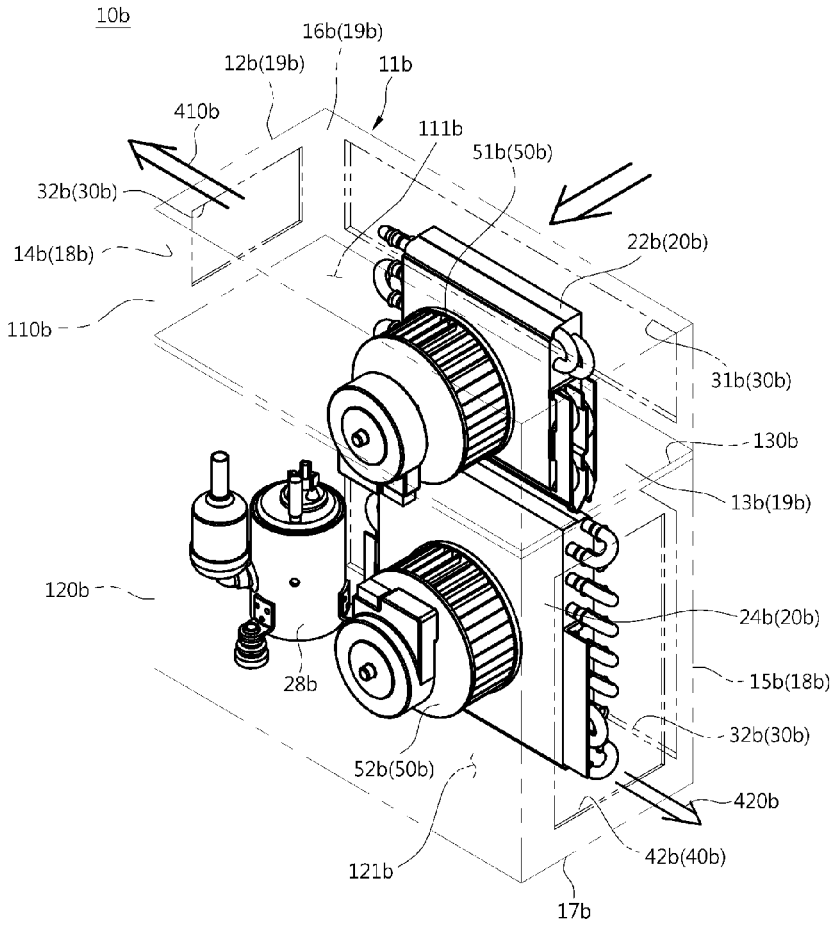

[Fig. 3]
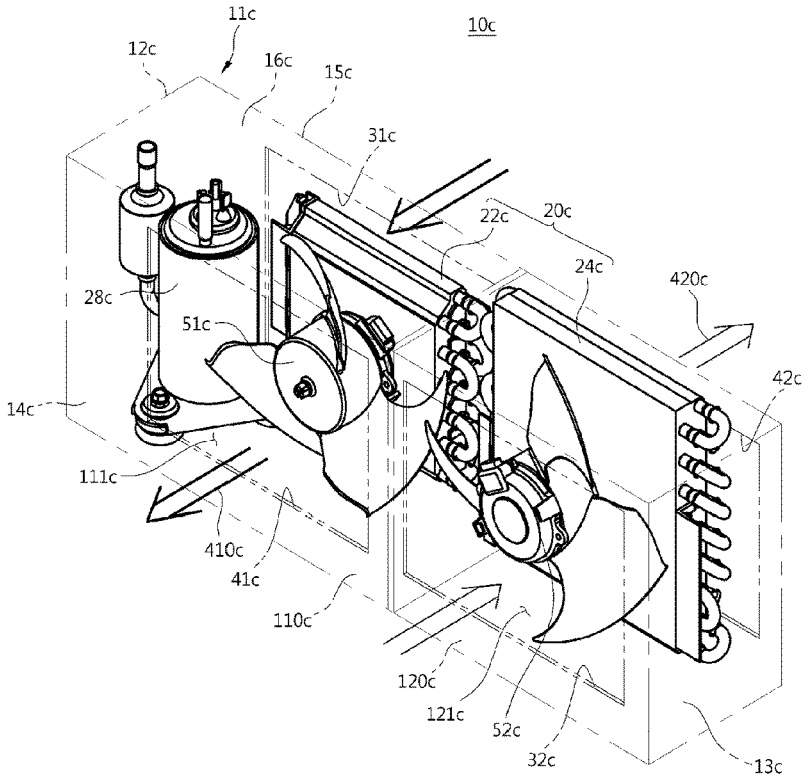
[Fig. 4]
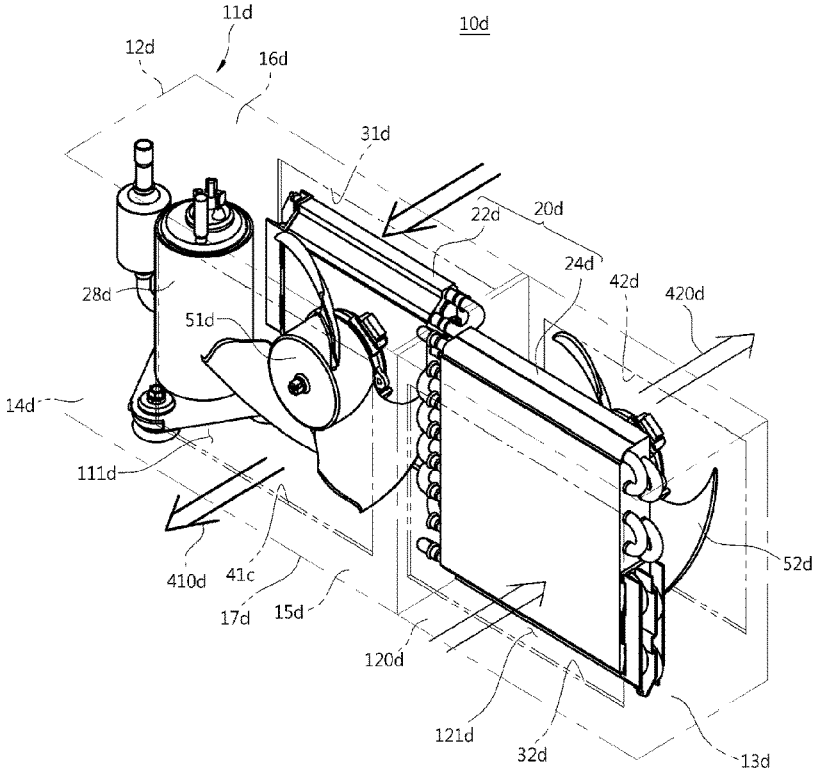

[Fig. 5]
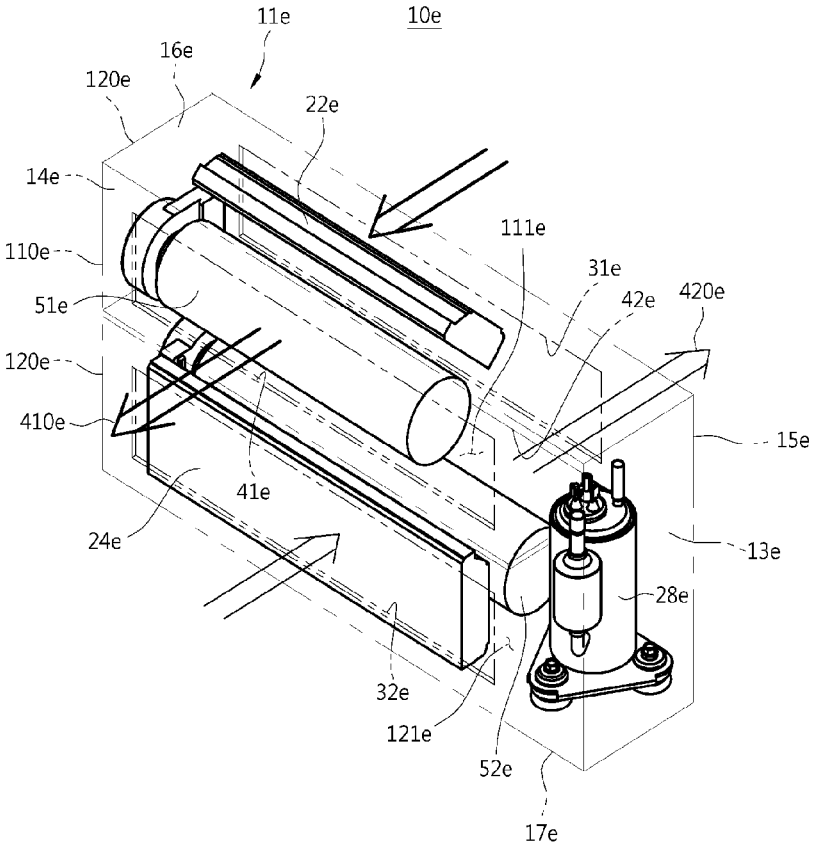

[Fig. 6]
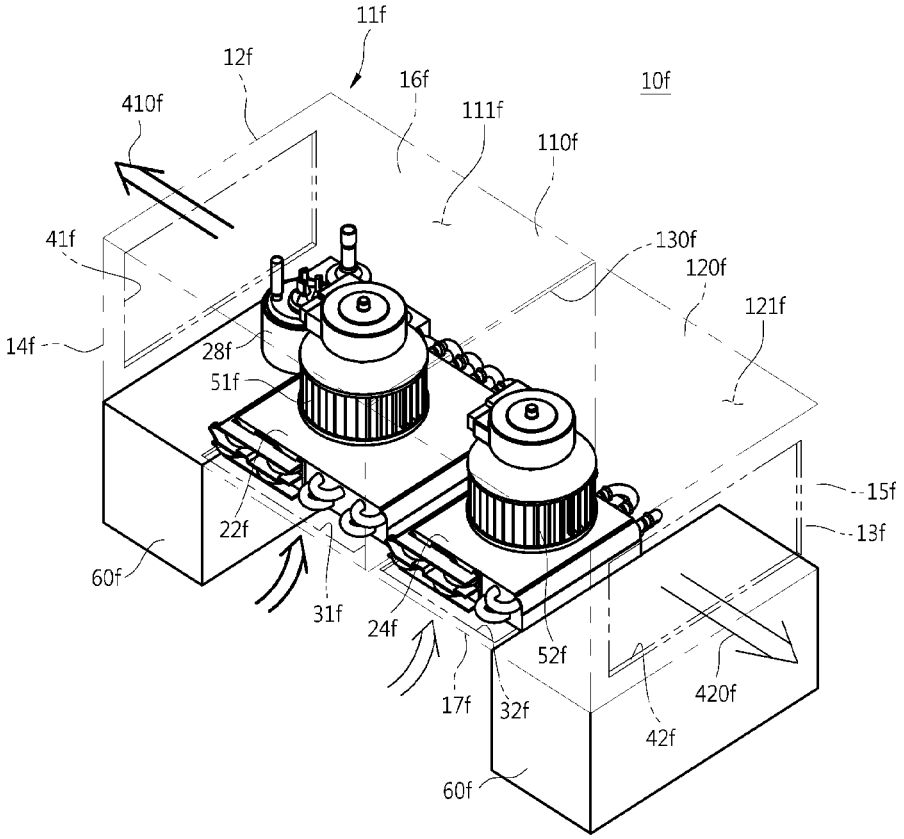

[Fig. 7]
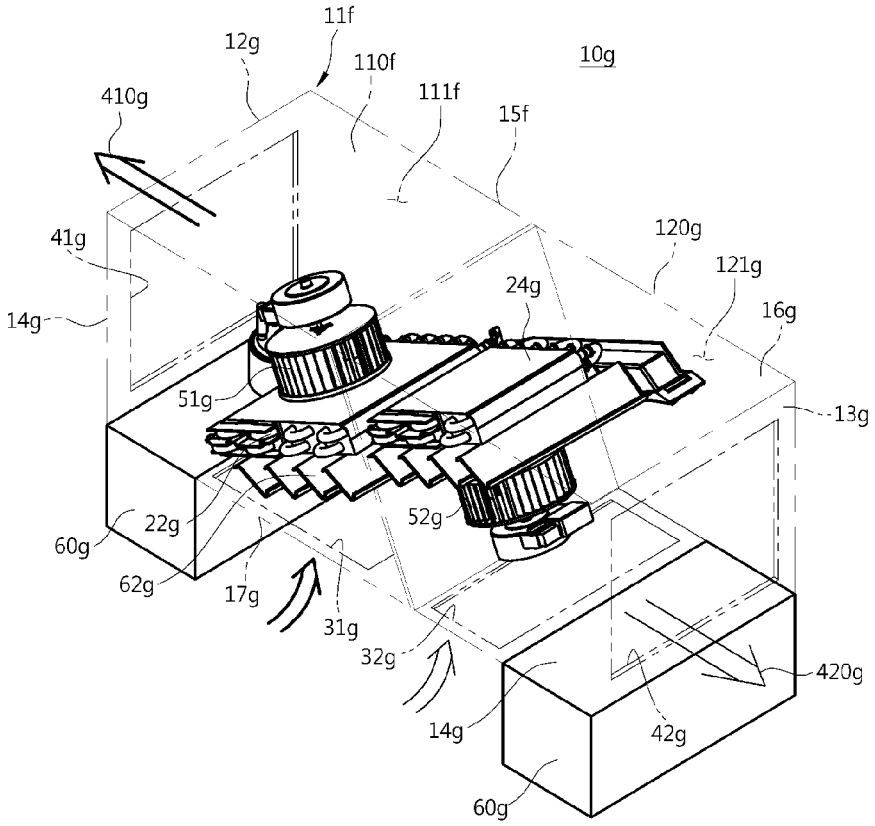

[Fig. 8]
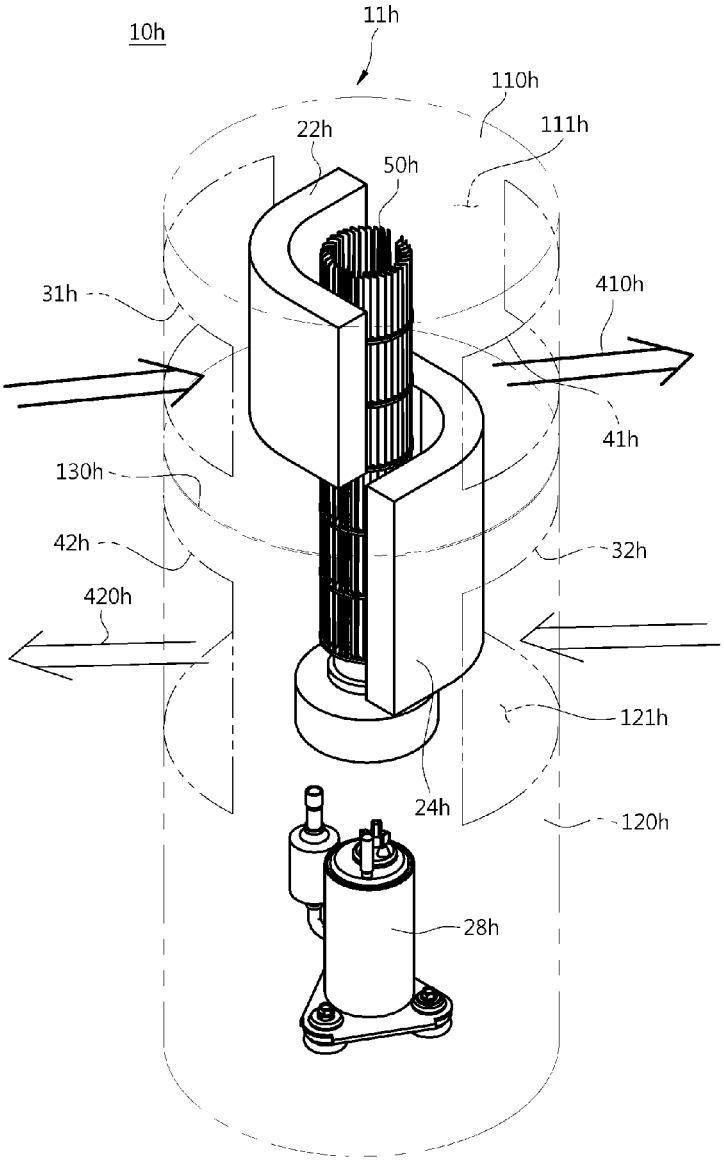

[Fig. 9]
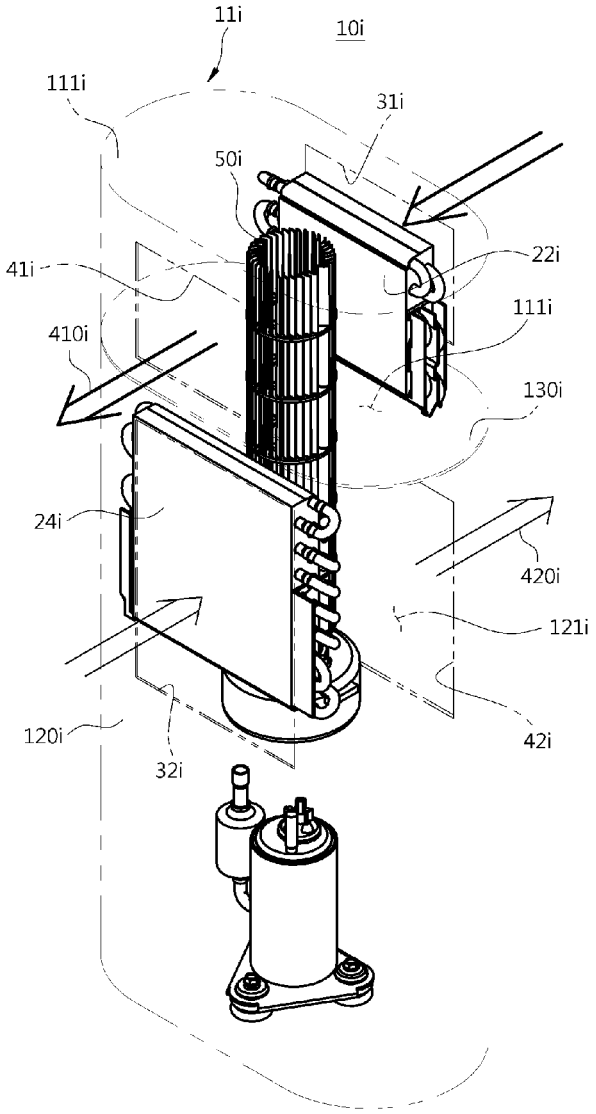

[Fig. 10]
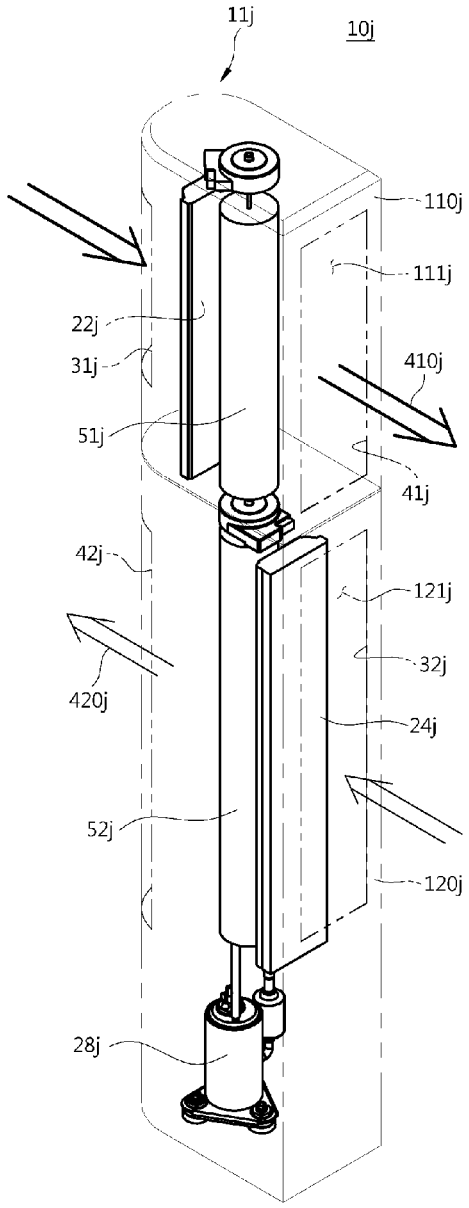

[Fig. 11]
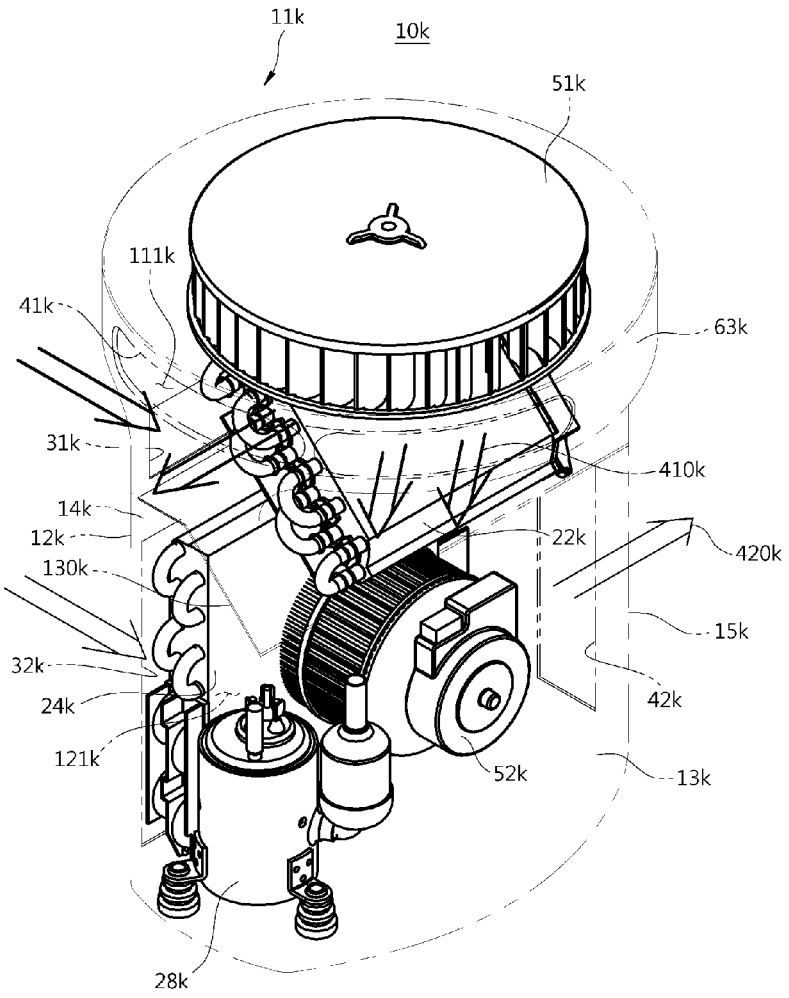

[Fig. 12]
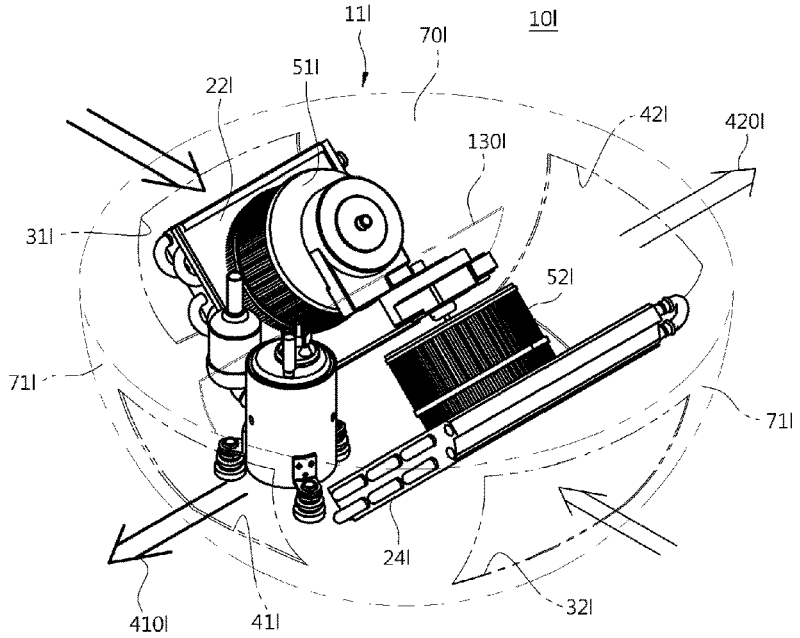
[Fig. 13]
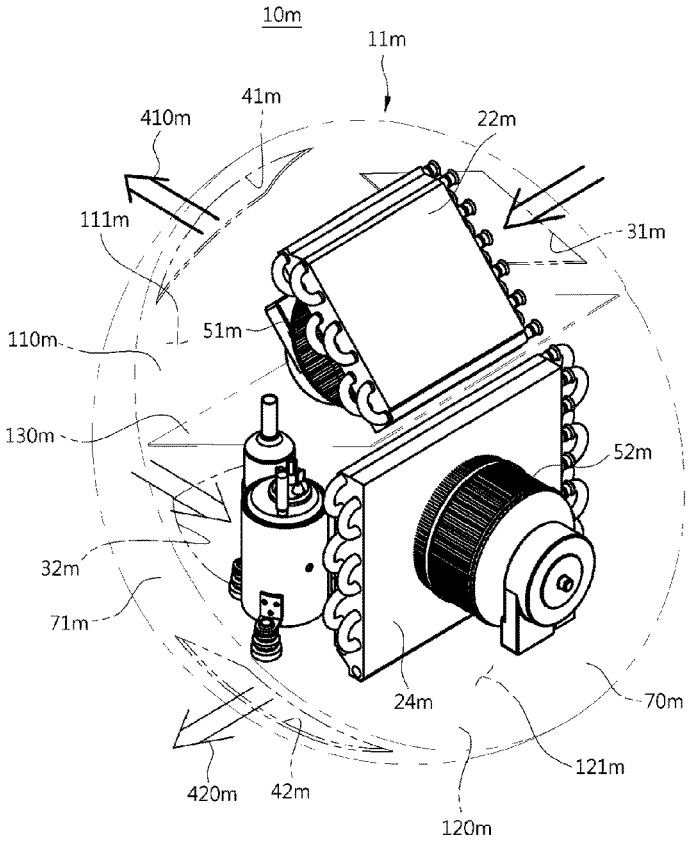

[Fig. 14]
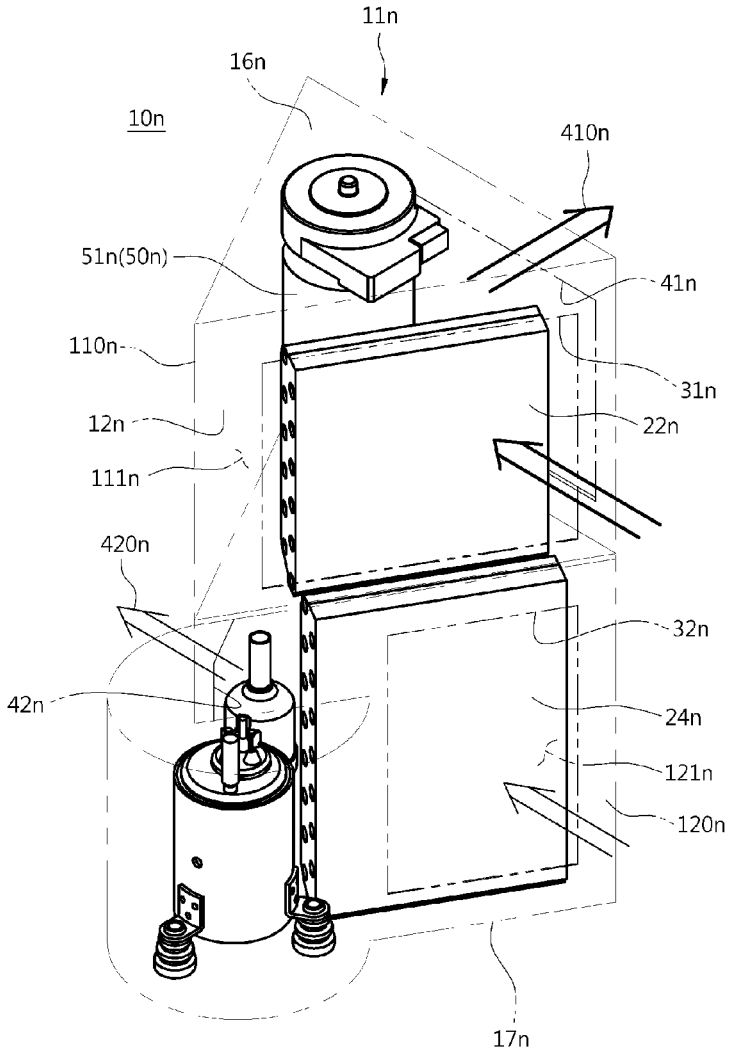

[Fig. 15]
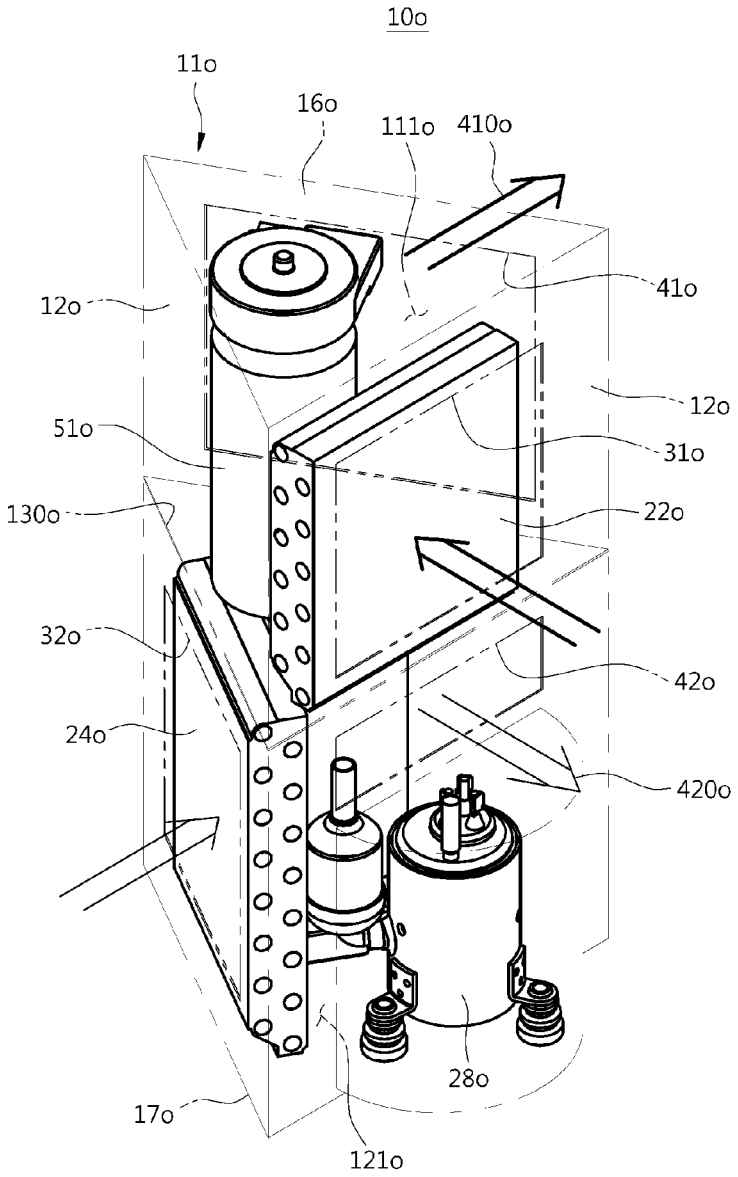

[Fig. 16]
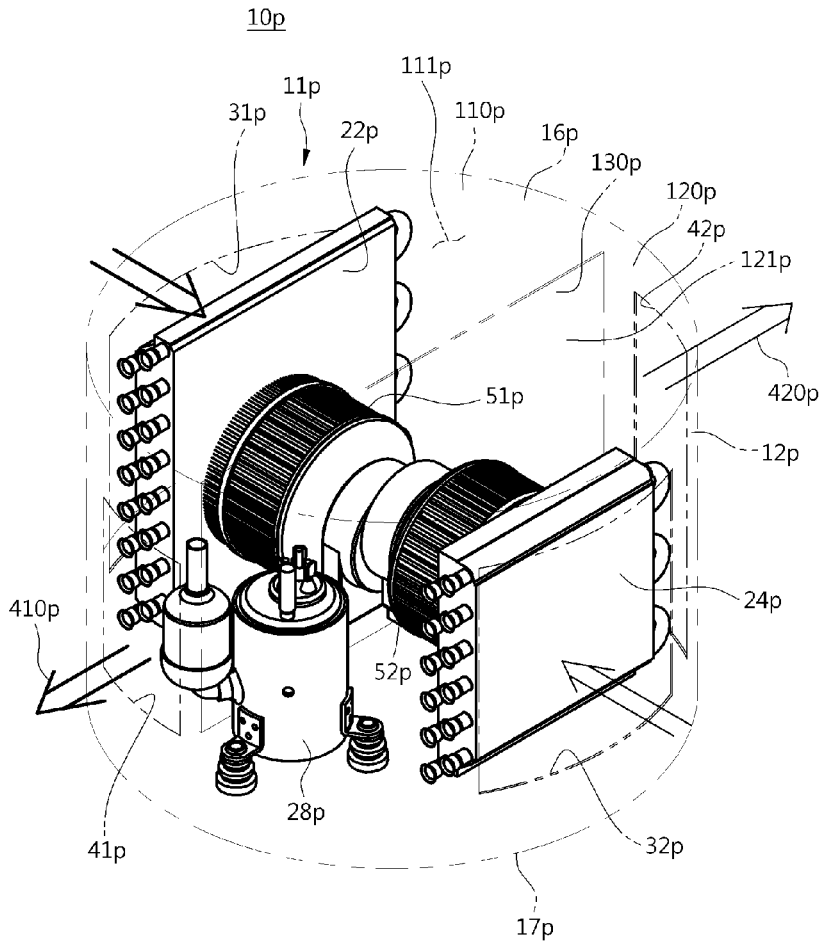

[Fig. 17]
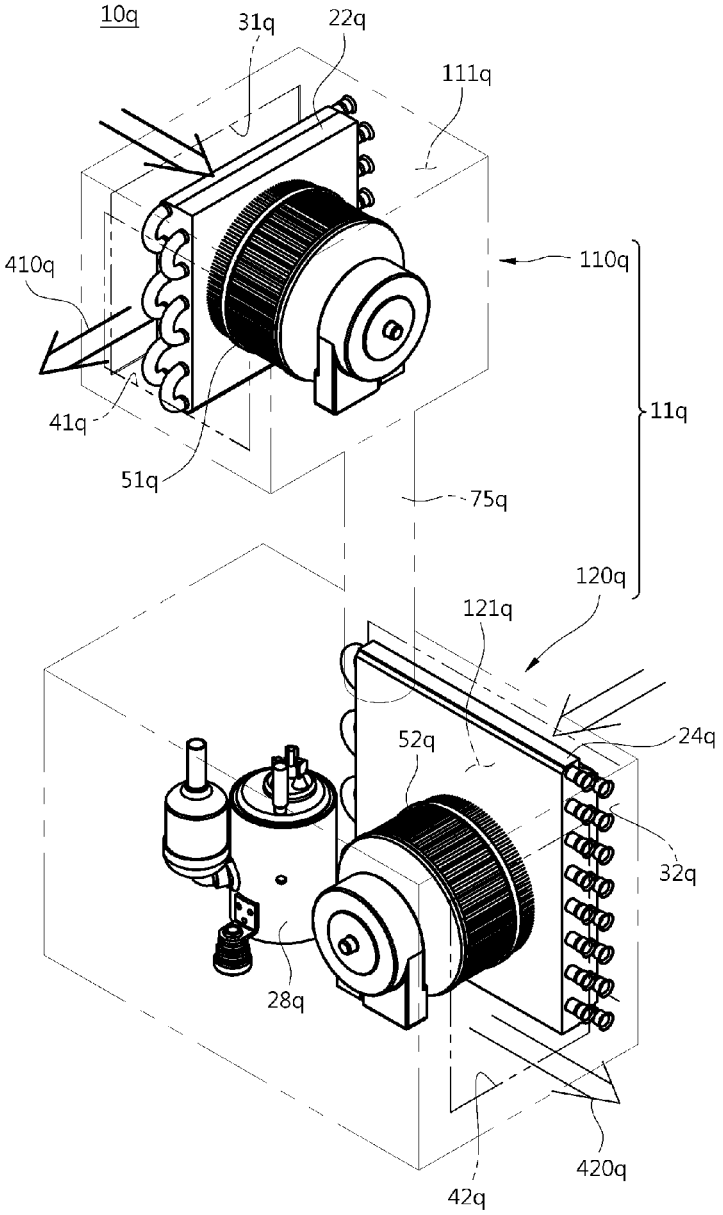

[Fig. 18]
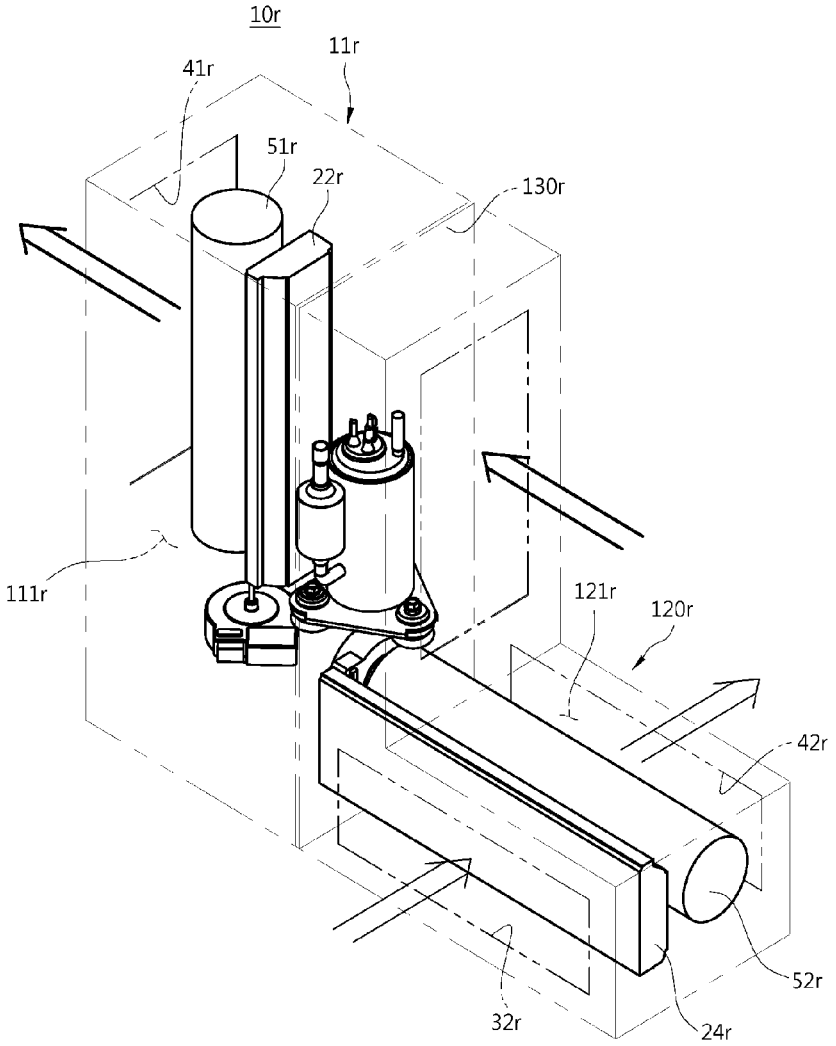

AIR CONDITIONER

CROSS-REFERENCE TO RELATED APPLICATION(S)

The present application claims priority under 35 U.S.C. § 365 to International Patent Application No. PCT/KR2015/005575 filed Jun. 3, 2015, entitled "AIR CONDITIONER", and, through International Patent Application No. PCT/KR2015/005575, to Korean Patent Application No. 10-2014-0069726 filed Jun. 9, 2014, each of which are incorporated herein by reference into the present disclosure as if fully set forth herein.

TECHNICAL FIELD

The present invention relates to an air conditioner, and more particularly, to a wall type air conditioner.

BACKGROUND ART

In general, an air conditioner is a device that removes dust and the like in the air while adjusting a temperature, humidity, an air current, distribution, and the like which are suitable for human activities using a refrigeration cycle. As main components constituting the refrigeration cycle, a compressor, a condenser, an evaporator, a blowing fan, and the like are included.

The air conditioner is classified into a split type air conditioner in which an indoor unit and an outdoor unit are separately installed and a wall type air conditioner in which the indoor unit and the outdoor unit are installed together in a single cabinet.

In general, even in a case of the wall type air conditioner, an indoor portion is provided toward a room and an outdoor portion is provided toward the outside while interposing a wall or a window therebetween.

Such an air conditioner has a larger volume, and even the wall type air conditioner occupies a part of the wall or the window so that there is a poor aesthetic effect.

In addition, even when air conditioning is performed in a predetermined area, air conditioning is performed with respect to the entire space rather than only the predetermined area, which is inefficient.

DISCLOSURE OF INVENTION

Technical Problem

The present invention is directed to providing an air conditioner whose structure is improved so that intensive air conditioning is performed with respect to a predetermined area.

Solution to Problem

One aspect of the present invention provides an air conditioner including: a main body in which a compressor for compressing a refrigerant, a condenser for condensing the refrigerant compressed by the compressor into a liquid phase, an expansion device for expanding the refrigerant condensed by the condenser into a refrigerant in a low pressure state, and an evaporator for exchanging heat with surroundings by evaporating the refrigerant in a low temperature and low pressure state are arranged; a mounting portion that is provided below the main body to separate the main body and a support surface; and a suction port that is provided on a bottom portion of the main body to correspond to the support surface, and into which air flows to perform heat exchange with the condenser or the evaporator.

Each of the condenser and the evaporator may be arranged on an inner side of the suction port within the main body.

The condenser and the evaporator may be arranged on the same plane within the main body.

Each of the condenser and the evaporator may be arranged to be inclined at a predetermined angle to the suction port within the main body.

The air conditioner may further include a first discharge port that is provided in the main body to discharge air heat-exchanged with the condenser to an air-conditioned space; and a second discharge port that is provided in the main body to discharge air heat-exchanged with the evaporator to the air-conditioned space, wherein the first discharge port and the second discharge port are arranged on mutually different surfaces of the main body.

A power consumption of the compressor may be 300 w or less.

The main body may be provided to be movable.

The main body may include a first main body that has a condensation space in which the condenser is arranged and a second main body that has an evaporation space in which the evaporator is arranged and that is partitioned from the condensation space.

Another aspect of the present invention provides an air conditioner including: a main body; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; an evaporator that exchanges heat with surroundings by evaporating the refrigerant in a low temperature and low pressure state; and a cross-flow fan that is provided inside the main body to discharge air heat-exchanged with the condenser or the evaporator to the outside, wherein the evaporator is arranged along a first region of the cross-flow fan, and the condenser is arranged along a second region adjacent to the first region in a longitudinal direction of the cross-flow fan.

The condenser and the evaporator may be arranged opposite to each other with respect to a rotational center of the cross-flow fan.

Each of the condenser and the evaporator may be formed into an arc shape to correspond to a circumference of the cross-flow fan.

Still another aspect of the present invention provides an air conditioner including: a main body; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; an evaporator that exchanges heat with surroundings by evaporating the refrigerant in a low temperature and low pressure state; and a blowing fan that is provided inside the main body to discharge air heat-exchanged with the condenser or the evaporator to the outside, wherein the blowing fan includes a first blowing fan that is arranged side by side with a support surface in which the main body is supported to thereby discharge the air heat-exchanged with the evaporator in a direction parallel with the support surface, and a second blowing fan that is provided to discharge the air heat-exchanged with the condenser in a direction different from the direction in which air is discharged by the first blowing fan.

Each of the first blowing fan and the second blowing fan may include a sirocco fan.

Yet another aspect of the present invention provides an air conditioner including: a main body; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; and an evaporator that exchanges heat with surroundings by evaporating the refrigerant in a low temperature and low pressure state, wherein the main body includes a circular flat panel that is provided to be flat, and a curved panel that is formed into a hemispherical shape and is connected to an end portion of the flat panel.

The main body may include a first discharge port that discharges air heat-exchanged with the condenser to an air-conditioned space, and a second discharge port that discharges air heat-exchanged with the evaporator to the air-conditioned space.

Each of the first discharge port and the second discharge port may be arranged on the curved panel.

The first discharge port and the second discharge port may be arranged opposite to each other with respect to a center of the curved panel.

Further aspect of the present invention provides an air conditioner including: a main body that includes an upper panel provided in a triangular shape, a lower panel provided to face the upper panel, and a plurality of side panels connecting the upper panel and the lower panel; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; and an evaporator that exchanges heat with surroundings by evaporating the refrigerant in a low temperature and low pressure state, wherein the main body includes a first discharge port that discharges air heat-exchanged with the condenser to an air-conditioned space and a second discharge port that discharges air heat-exchanged with the evaporator to the air-conditioned space, the first discharge port is arranged in any one of the plurality of side panels, and the second discharge port is arranged in another one of the plurality of side panels to be spaced apart from the first discharge port.

Further aspect of the present invention provides an air conditioner including: a main body that includes an upper panel provided in a circular shape, a lower panel provided to face the upper panel, and a plurality of side panels provided in a curved shape to connect the upper panel and the lower panel; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; and an evaporator that exchanges heat with surroundings by evaporating the refrigerant in a low temperature and low pressure state, wherein the main body includes a first discharge port that discharges air heat-exchanged with the condenser to an air-conditioned space and a second discharge port that discharges air heat-exchanged with the evaporator to the air-conditioned space, the first discharge port is arranged on the side panel, and the second discharge port is arranged on the side panel so as to face the first discharge port.

Further aspect of the present invention provides an air conditioner including: a main body; a compressor that is provided inside the main body to compress a refrigerant; a condenser that condenses the refrigerant compressed by the compressor into a liquid phase; an expansion device that expands the refrigerant condensed by the condenser into a refrigerant in a low pressure state; and an evaporator that exchanges heat with surroundings by evaporating the refrigerant in a low temperature and low pressure state, wherein the main body includes a first main body that includes the evaporator and a second main body that includes the condenser and is arranged so as to be spaced apart from the first main body.

The air conditioner may further include: a refrigerant pipe that connects the first main body and the second main body so that the refrigerant is movable.

Advantageous Effects of Invention

In an air conditioner according to the present invention, air conditioning may be performed with respect to only a predetermined area rather than the entire space, thereby attaining miniaturization of the air conditioner.

Also, the air conditioner may be provided to be movable and enable an intensive operation with respect to a predetermined area, and thereby be available for personal use.

BRIEF DESCRIPTION OF DRAWINGS

FIG. 1*a* is a view showing arrangement of an air conditioner according to a first embodiment of the present invention;

FIG. 1*b* is a perspective view showing an air conditioner according to a first embodiment of the present invention;

FIG. 2 is a perspective view showing an air conditioner according to a second embodiment of the present invention;

FIG. 3 is a perspective view showing an air conditioner according to a third embodiment of the present invention;

FIG. 4 is a perspective view showing an air conditioner according to a 4th embodiment of the present invention;

FIG. 5 is a is a perspective view showing an air conditioner according to a 5th embodiment of the present invention;

FIG. 6 is a is a perspective view showing an air conditioner according to a 6th embodiment of the present invention;

FIG. 7 is a is a perspective view showing an air conditioner according to a 7th embodiment of the present invention;

FIG. 8 is a is a perspective view showing an air conditioner according to an 8th embodiment of the present invention;

FIG. 9 is a is a perspective view showing an air conditioner according to a 9th ninth embodiment of the present invention;

FIG. 10 is a is a perspective view showing an air conditioner according to a 10th embodiment of the present invention;

FIG. 11 is a is a perspective view showing an air conditioner according to an 11th embodiment of the present invention;

FIG. 12 is a is a perspective view showing an air conditioner according to a 12th embodiment of the present invention;

FIG. 13 is a is a perspective view showing an air conditioner according to a 13th embodiment of the present invention;

FIG. 14 is a is a perspective view showing an air conditioner according to a 14th embodiment of the present invention;

FIG. 15 is a is a perspective view showing an air conditioner according to a 15th embodiment of the present invention;

FIG. 16 is a is a perspective view showing an air conditioner according to a 16th embodiment of the present invention;

FIG. 17 is a is a perspective view showing an air conditioner according to a 17th embodiment of the present invention; and FIG. 18 is a is a perspective view showing an air conditioner according to a 18th embodiment of the present invention.

MODE FOR THE INVENTION

Hereinafter, embodiments of the present invention will be described in detail with reference to the accompanying drawings.

Prior to description, reference numerals are given as numerals according to configuration and alphabets according to embodiments in order to distinguish a plurality of embodiments.

FIG. 1 is a view showing an air conditioner 10*a* according to a first embodiment of the present invention.

The air conditioner 10*a* according to the present invention performs an air conditioning operation with respect to a localized region within an air-conditioned space 1 to be air-conditioned. That is, the air conditioning operation is intensively performed with respect to the localized region rather than the whole of the air-conditioned space 1.

The air conditioner 10*a* may be provided to be movable. That is, a handle portion (not shown) is movably provided in a main body 11*a* so that the air conditioner 10*a* may be movable to a required position within the air-conditioned space 1. According to an embodiment of the present invention, the air conditioner 10*a* may discharge air-conditioned discharge air only to a predetermined space, and thereby may be provided to be miniaturized.

FIG. 1*b* is a perspective view showing an air conditioner 10*a* according to a first embodiment of the present invention.

The air conditioner 10*a* includes the main body 11*a*, a heat exchanger 20*a*, and an expansion device 26*a*. The heat exchanger 20*a* may include a condenser 24*a* and an evaporator 22*a*.

The main body 11*a* is provided to form an appearance thereof. The main body 11*a* may be formed by a plurality of appearance panels forming an appearance thereof. The main body 11*a* may have a substantially hexahedral shape, and provided to partition an inner structure and the outside.

The appearance panel includes left and right panels 12*a* and 13*a* forming left and right surfaces thereof, a front panel 14*a* forming a front surface thereof, a rear panel 15*a* forming a rear surface thereof, and upper and lower panels 16*a* and 17*a* formed on upper and lower portions thereof.

The main body 11*a* may include a suction port 30*a* for introducing air from the outside and a discharge port 40*a* for discharging air inside the main body 11*a* to the outside.

The main body 11*a* may include a first main body 110*a* and a second main body 120*a*. The first main body 110*a* and the second main body 120*a* may be partitioned. Specifically, the first main body 110*a* and the second main body 120*a* may be partitioned so as to prevent air from flowing between the first main body 110*a* and the second main body 120*a*. In the main body 11*a*, a partition wall 130*a* for separating the first main body 110*a* and the second main body 120*a* may be provided.

The first main body 110*a* may function as an indoor unit of a split type air conditioner, and include the evaporator 22*a* and a first blowing fan 51*a* which will be described later. The main body 120*a* may function as an outdoor unit of the split type air conditioner, and include the condenser 24*a* and a second blowing fan 52*a* which will be described later. However, the present invention is not limited thereto, and thus the first main body 110*a* may function as the outdoor unit and the second main body 120*a* may function as the indoor unit. The evaporator 22*a* is arranged inside the first main body 110*a*, and thereby the inside of the first main body 110*a* may be referred to as an evaporation space 111*a*, and the condenser 24*a* is arranged inside the second main body 120*a* and thereby the inside of the second main body 120*a* may be referred to as a condensation space 121*a*.

A compressor 28*a* compresses a refrigerant into a high temperature and high pressure state to discharge the compressed refrigerant, and the compressed refrigerant flows into the condenser 24*a*. The condenser 24*a* condenses the refrigerant compressed by the compressor 28*a* into a liquid phase. Heat is emitted to the surroundings through a condensation process.

The expansion device 26*a* may expand a liquid refrigerant in the high temperature and high pressure state condensed by the condenser 24*a* into a liquid refrigerant in a low pressure state, and the evaporator 22*a* may evaporate the refrigerant expanded by the expansion device 26*a* while attaining refrigeration effects by heat exchange with an object to be cooled using evaporation latent heat of the refrigerant and allow the refrigerant in a low temperature and low pressure state to return to the compressor 28*a*.

The compressor 28*a* may be provided to be heavy, and thereby arranged in a lower portion inside the main body 11*a*. Thus, the overall center of gravity of the air conditioner 10*a* is positioned downward, so that the air conditioner 10*a* may be stably supported.

The air conditioner 10*a* according to the present invention is to perform air conditioning with respect to a predetermined region rather than the whole of the air-conditioned space 1, and therefore a compression date of the refrigerant may be provided to be smaller compared to the air conditioner 10*a* to perform air conditioning with respect to the whole of the air-conditioned space 1. That is, power consumption of the compressor 28*a* applied to the air conditioner 10*a* according to the present invention may be smaller than that of the compressor 28*a* of the air conditioner 10*a* to perform air conditioning with respect to the whole of the air-conditioned space 1. According to the present embodiment, the power consumption of the compressor 28*a* is provided to be smaller than 300 W. Thus, the air conditioner 10*a* may perform air conditioning with respect to the predetermined region of the air-conditioned space 1.

In the first main body 110*a*, a first suction port 31*a* through which external air is introduced and a first discharge port 41*a* through which the air introduced through the first suction port 31*a* is discharged may be provided. In the second main body 120, a second suction port 32*a* through which external air is introduced and a second discharge port 42*a* through which the air introduced through the second suction port 32*a* is discharged may be provided.

The air conditioner 10*a* according to the present invention performs air conditioning with respect to the predetermined region of the air-conditioned space 1, and therefore the first discharge port 41*a* and the second discharge port 42*a* are arranged within the same air-conditioned space 1. That is, air cooled through the evaporator 22*a* is discharged through the first discharge port 41*a*, air heated through the condenser 24*a* is discharged through the second discharge port 42*a*, and the first discharge port 41*a* and the second discharge port 42*a* are arranged within the same air-conditioned space 1. In an operation process of the air conditioner 10*a*, the first discharge port 41*a* is allowed to face a predetermined region in the air-conditioned space 1, and therefore air conditioning may be performed with respect to the corresponding region.

The first discharge port 41*a* and the second discharge port 42*a* may be arranged so as to be spaced apart from each other. That is, the air discharged from the first discharge port 41*a* and the air discharged from the second discharge port 42*a* may be prevented from being mixed together. In addition, the first discharge port 41*a* and the second discharge port 42*a* are spaced apart from each other, so that the air discharged from the second discharge port 42*a* may be arranged so as not to affect the predetermined region on which air conditioning is to be performed.

Specifically, the first discharge port 41*a* may be provided in any one of the plurality of appearance panels, and the second discharge port 42*a* may be provided in another one of the plurality of appearance panels. In the present embodiment, the first discharge port 41*a* may be arranged in the front panel 14*a* and the second discharge port 42*a* may be arranged in the rear panel 15*a* so that the air discharged from the first discharge port 41*a* and the air discharged from the second discharge port 42*a* are provided so as not to affect each other. That is, when it is assumed that an air flow of the air discharged from the first discharge port 41*a* is first discharge air 410*a* and an air flow of the air discharged from the second discharge port 42*a* is second discharge air 420*a*, the first discharge port 41*a* and the second discharge port 42*a* may be provided in such a manner that the first discharge air 410*a* and the second discharge air 420*a* are discharged so as not to interfere with each other.

The air conditioner 10*a* may include a blowing fan 50*a*.

The blowing fan 50*a* is arranged adjacent to the heat exchanger 20*a* so that air heat-exchanged with the heat exchanger 20*a* is allowed to flow in and out. Specifically, the blowing fan 50*a* includes the first blowing fan 51*a* arranged adjacent to the evaporator 22*a* and the second blowing fan 52*a* arranged adjacent to the condenser 24*a*.

The first blowing fan 51*a* discharges air that is introduced into the air-conditioned space 1 to be heat-exchanged with the evaporator 22*a* to a predetermined region of the air-conditioned space 1 through the first discharge port 41*a*, and the second blowing fan 52*a* discharges air that is introduced into the air-conditioned space 1 to be heat-exchanged with the condenser 24*a* to the air-conditioned space 1 through the second discharge port 42*a*.

The type of the blowing fan 50*a* is not limited, and may include at least one of a cross-flow fan, a sirocco fan, and a propeller fan. In the present embodiment, the cross-flow fan may be applicable as the first blowing fan 51*a* and the propeller fan may be applicable as the second blowing fan 52*a*, but the present invention is not limited thereto. Thus, other types of fans may be applicable.

In the present embodiment, the main body 11*a* is provided to have a slim shape in a front and back direction. That is, when it is assumed that the front panel 14*a* and the rear panel 15*a* are first surfaces 18*a*, and the left panel 12*a*, the right panel 13*a*, the upper panel, and the lower panel are second surfaces 19*a*, the main body 11*a* includes a pair of first surfaces 18*a* facing each other and the second surfaces 19*a* each having a smaller area than that of the first surface 18*a* between the pair of first surfaces 18*a*. The condenser 24*a* and the evaporator 22*a* may be arranged side by side with the first surface 18*a*. The main body 11*a* may have a slim shape in the front and back direction, and therefore the condenser 24*a* and the evaporator 22*a* may be arranged substantially side by side with each other.

In the present embodiment, the evaporator 22*a* and the condenser 24*a* may be vertically arranged. Thus, the first main body 110*a* and the second main body 120*a* may be vertically arranged. The evaporator 22*a* and the condenser 24*a* are vertically arranged side by side and condensed water generated from the evaporator 22*a* falls down to the condenser 24*a*, so that heat exchange efficiency in the condenser 24*a* may be improved.

The first blowing fan 51*a* may be provided inside the first main body 110*a*, and discharge the air heat-exchanged with the evaporator 22*a* through the first discharge port 41*a* to the predetermined region of the air-conditioned space 1.

The second blowing fan 52*a* may be provided inside the second main body 120*a* and discharge the air heat-exchanged with the condenser 24*a* through the second discharge port 42*a* to the air-conditioned space 1. The first blowing fan 51*a* and the second blowing fan 52*a* allow the air discharged from the inside of the main body 11*a* to blow in mutually different directions, and therefore the air discharged by the first blowing fan 51*a* and the second blowing fan 52*a* may be prevented from being mixed together.

Hereinafter, an air conditioner 10*b* according to a second embodiment of the present invention will be described.

Prior to description, reference numerals are given as numerals according to configuration and alphabets according to embodiments in order to distinguish a plurality of embodiments. Thus, even when the alphabets are different, reference numerals having the same numerals may have the same configuration. Descriptions of reference numerals in embodiments which will be described below are the same as those of the reference numerals of the above-described embodiment. Thus, repeated description with respect to the above-described embodiment will be omitted. In the second embodiment unlike the first embodiment, the end of each reference numeral is given as "b".

FIG. 2 is a perspective view showing an air conditioner according to a second embodiment of the present invention.

In the present embodiment, the type of a blowing fan 50*b* and a blowing direction are different from those in the first embodiment.

In the present embodiment, a main body 11*b* is provided to have a slim shape in a front and back direction. That is, when it is assumed that a front panel 14*b* and a rear panel 15*b* are first surfaces 18*b*, and a left panel 12*b*, a right panel 13*b*, an upper panel, and a lower panel are second surfaces 19*b*, the main body 11*b* includes a pair of first surfaces 18*b* facing each other and second surfaces 19*b* each having a smaller area than that of the first surface 18*b* between the pair of first surfaces 18*b*.

In the present embodiment, both a first blowing fan 51*b* and a second blowing fan 52*b* may be formed as a sirocco fan.

Both a first suction port 31*b* and a second suction port 32*b* may be provided in the rear panel 15*b*. A first discharge port 41*b* and a second discharge port 42*b* may be respectively provided in the left panel 12*b* and the right panel 13*b*. Through this structure, first discharge air 410*b* and second discharge air 420*b* are prevented from interfering with each other. However, positions of a suction port 30*b* and a discharge port 40*b* are not limited thereto.

Hereinafter, an air conditioner 10*c* according to a third embodiment of the present invention will be described.

Repeated description with respect to the above-described embodiments will be omitted. In the third embodiment unlike the first embodiment, the end of each reference numeral is given as "c".

FIG. 3 is a perspective view showing an air conditioner according to a third embodiment of the present invention.

In the present embodiment, arrangement of components is different from that in the first embodiment.

In the present embodiment, a main body 11*c* may be provided to have a slim shape in a front and back direction. That is, when it is assumed that a front panel 14*c* and a rear panel 15*c* are first surfaces 18*c* and a left panel 12*c*, a right panel 13*c*, an upper panel, and a lower panel are second surfaces 19*c*, the main body 11*c* includes a pair of first surfaces 18*c* facing each other and second surfaces 19*c* each having a smaller area than that of the first surface 18*c* between the pair of first surfaces 18*c*.

In the present embodiment, an evaporator 22*c* and a condenser 24*c* may be arranged on right and left sides. Thus, in the present embodiment, a first main body 110*c* and a second main body 120*c* may be arranged on right and left sides. The evaporator 22*c* and the condenser 24*c* may be arranged side by side on right and left sides. In the evaporator 22*c*, condensed water is generated on the surface of the evaporator 22*c* in a heat exchange process, and the surface of the condenser 24*c* is wet with the generated condensed water using a drain pump (not shown), thereby improving heat exchange efficiency in the condenser 24*c*.

Both a first blowing fan 51*c* and a second blowing fan 52*c* may be formed as a propeller fan. A first suction port 31*c* may be provided in the rear panel 15*c*, a first discharge port 41*c* may be provided in the front panel 14*c*, and the first blowing fan 51*c* may be disposed between the first suction port 31*c* and the first discharge port 41*c*. A second suction port 32*c* may be provided in the front panel 14*c*, a second discharge port 42*c* may be provided in the rear panel 15*c*, and the second blowing fan 52*c* may be disposed between the second suction port 32*c* and the second discharge port 42*c*. Through this structure, first discharge air 410*c* and second discharge air 420*c* are prevented from interfering with each other.

Hereinafter, an air conditioner 10*d* according to a 4th embodiment of the present invention will be described.

Repeated description with respect to the above-described embodiments will be omitted. In the 4th embodiment unlike the first embodiment, the end of each reference numeral is given as "d".

FIG. 4 is a perspective view showing an air conditioner according to a 4th embodiment of the present invention.

In the present embodiment, arrangement of a condenser 24*d* is different from that in the third embodiment.

In the third embodiment, the evaporator 22*c* and the condenser 24*c* are arranged side by side on right and left sides, but in the present embodiment, an evaporator 22*d* and the condenser 24*d* are arranged on right and left sides to be spaced apart from each other in a front and back direction.

In the third embodiment, the evaporator 22*c* is disposed between the first blowing fan 51*c* and the first suction port 31*c*, and the condenser 24*c* is disposed between the second blowing fan 52*c* and the second discharge port 42*c*. However, in the 4th embodiment, the evaporator 22*d* is disposed between a first blowing fan 51*d* and a first suction port 31*d*, and the condenser 24*d* is disposed between a second blowing fan 52*d* and a second suction port 32*d*. Through this structure, first discharge air 410*d* and second discharge air 420*d* are prevented from interfering with each other.

Hereinafter, an air conditioner 10*e* according to a 5th embodiment of the present invention will be described.

Repeated description with respect to the above-described embodiments will be omitted. In the 5th embodiment unlike the first embodiment, the end of each reference numeral is given as "e".

FIG. 5 is a perspective view showing an air conditioner according to a 5th embodiment of the present invention.

In the present embodiment, a main body 11*e* may be provided to have a slim shape in a front and back direction. That is, when it is assumed that a front panel 14*e* and a rear panel 15*e* are first surfaces 18*e*, and a left panel 12*e*, a right panel 13*e*, an upper panel, and a lower panel are second surfaces 19*e*, the main body 11*e* includes a pair of first surfaces 18*e* facing each other, and second surfaces 19*e* each having a smaller area than that of the first surface 18*e* between the pair of first surfaces 18*e*.

In the present embodiment, both a first blowing fan 51*e* and a second blowing fan 52*e* may be formed as a cross-flow fan. The first blowing fan 51*e* and the second blowing fan 52*e* may be vertically disposed.

An evaporator 22*e* is provided adjacent to the first blowing fan 51*e*, and a condenser 24*e* is disposed adjacent to the second blowing fan 52*e*. A first suction port 31*e* may be provided in the rear panel 15*e*, a first discharge port 41*e* may be disposed in the front panel 14*e*, a second suction port 32*e* may be provided in the front panel 14*e*, and a second discharge port 42*e* may be disposed in the rear panel 15*e*. Through this, first discharge air 410*e* and second discharge air 420*e* are prevented from interfering with each other.

Hereinafter, an air conditioner 10*f* according to a 6th embodiment of the present invention will be described.

Repeated description with respect to the above-described embodiments will be omitted. In the 6th embodiment unlike the first embodiment, the end of each reference numeral is given as "f".

FIG. 6 is a perspective view showing an air conditioner according to a 6th embodiment of the present invention.

In the present embodiment, the air conditioner 10*f* includes a mounting portion 60*f*.

The mounting portion 60*f* is provided below a main body 11*f*, and provided so as to stably support the main body 11*f* on the floor. In addition, the mounting portion 60*f* is provided to separate a support surface on which the air conditioner is supported and the main body 11*f*.

A first suction port 31*f* and a second suction port 32*f* may be provided on a lower portion of the main body 11*f*. That is, the suction ports 31*f* and 32*f* are provided to correspond to the support surface so as not to be easily exposed from the outside.

An evaporator 22*f* and a condenser 24*f* may be respectively arranged on inner sides of the first suction port 31*f* and the second suction port 32*f*. In addition, the evaporator 22*f* and the condenser 24*f* may be arranged on the same plane parallel to the suction ports 31*f* and 32*f*.

The first suction port 31*f* and the second suction port 32*f* are provided on a lower panel 17*f* of the main body 11*f*. The main body 11*f* is provided to be spaced apart from the bottom surface by the mounting portion 60*f*, and therefore external air may be introduced into the main body 11*f* through the first suction port 31*f* and the second suction port 32*f* of the lower panel 17*f*.

Both a first blowing fan 51*f* and a second blowing fan 52*f* may be formed as a sirocco fan. In addition, a first discharge port 41*f* and a second discharge port 42*f* may be respectively provided in a left panel 12*f* and a right panel 13*f*. The evaporator 22*f* and the condenser 24*f* may be arranged to correspond to the first suction port 31*f* and the second suction port 32*f*.

Through this, air introduced through the first suction port 31*f* is discharged to the first discharge port 41*f* via the evaporator 22*f* and the first blowing fan 51*f*, and air introduced through the second suction port 32*f* is discharged to the second discharge port 42*f* via the condenser 24*f* and the second blowing fan 52*f*. Through this structure, first discharge air 410*f* and second discharge air 420*f* may be prevented from interfering with each other.

Hereinafter, an air conditioner 10*g* according to a 7th embodiment of the present invention will be described.

Repeated description with respect to the above-described embodiments will be omitted. In the 7th embodiment unlike the first embodiment, the end of each reference numeral is given as "g".

FIG. 7 is a perspective view showing an air conditioner according to a 7th embodiment of the present invention.

In the present embodiment, arrangement of an evaporator 22*g* and a condenser 24*g* is different from that in the 6th embodiment.

The evaporator 22*g* and the condenser 24*g* may be provided so as to be spaced apart from each other at a predetermined angle with respect to a lower panel 17*g*. That is, the evaporator 22*g* and the condenser 24*g* may be arranged so as to be inclined at a predetermined angle from suction ports 31*g* and 32*g*. In addition, the evaporator 22*g* and the condenser 24*g* may be arranged on the same plane parallel to the suction ports 31*g* and 32*g*.

A first discharge port 41*g* may be provided in a right panel 13*g*, and a second discharge port 42*g* may be provided in a left panel 12*g*. Both a first blowing fan 51*g* and a second blowing fan 52*g* may be formed as a sirocco fan.

The first suction port 31*g* may be provided in an upper panel 16*g*, and air passing through the evaporator 22*g* may be discharged to the first discharge port 41*g* of the right panel 13*g* by the first blowing fan 51*g*. The second suction port 32*g* may be provided in the lower panel 17*g*, and air passing through the condenser 24*g* may be discharged to the second discharge port 42*g* of the left panel 12*g* by the second blowing fan 52*g*.

A louver portion 62*g* may be provided in the evaporator 22*g* and the condenser 24*g*. The louver portion 62*g* may be provided to guide air passing through the inside of a first main body 110*g* to the evaporator 22*g* and the first blowing fan 51*g*. In addition, the louver portion 62*g* may be provided to guide air passing through the inside of a second main body 120*g* to the condenser 24*g* and the second blowing fan 52*g*.

Hereinafter, an air conditioner 10*h* according to an 8th embodiment of the present invention will be described.

Repeated description with respect to the above-described embodiments will be omitted. In the 8th embodiment unlike the first embodiment, the end of each reference numeral is given as "h".

FIG. 8 is a perspective view showing an air conditioner according to an 8th embodiment of the present invention.

In the present embodiment, a main body 11*h* is provided to have a height larger than a width of a lower surface thereof. That is, the main body 11*h* may be provided to have a tower shape. The shape of the main body 11*h* is not limited, and the main body 11*h* may be provided to have a cylindrical shape with circular upper and lower surfaces thereof.

In the present embodiment, a first blowing fan 51*h* and a second blowing fan 52*h* may be vertically arranged side by side. In addition, the first blowing fan 51*h* and the second blowing fan 52*h* may be applicable as a cross-flow fan, and arranged long in a vertical direction.

In addition, the first blowing fan 51*h* and the second blowing fan 52*h* may be divided into a first region and a second region by the cross-flow fan. Each of the blowing fans 51*h* and 52*h* may include the first region and the second region adjacent to the first region in a longitudinal direction of the cross-flow fan. In the first region, an evaporator 22*h* may be disposed, and in the second region, a condenser 24*h* may be disposed. The first region and the second region may be provided to be connected to each other, or arranged to be spaced apart from each other while having a predetermined space therebetween.

The first blowing fan 51*h* and the second blowing fan 52*h* may be provided to be respectively divided into the first region and the second region so as to correspond to a size of each of the evaporator 22*h* and the condenser 24*h*.

The first blowing fan 51*h* and the second blowing fan 52*h* may be provided to be rotated together using a single motor. The first blowing fan 51*h* and the second blowing fan 52*h* are rotated together in the same rotational direction using the single motor, and therefore blades of the first blowing fan 51*h* and the second blowing fan 52*h* may be arranged in the opposite direction to each other.

Through this structure, the first blowing fan 51*h* and the second blowing fan 52*h* may be rotated in the same direction, but first discharge air 410*h* and second discharge air 420*h* may have different directions from each other.

The evaporator 22*h* and the condenser 24*h* may be provided adjacent to the first blowing fan 51*h* and the second blowing fan 52*h*. In addition, the evaporator 22*h* and the condenser 24*h* may be formed into an arc shape having a predetermined curvature, and thereby surrounded by a predetermined section of the first blowing fan 51*h* and the second blowing fan 52*h*, respectively.

The evaporator 22*h* and the condenser 24*h* may be arranged opposite to each other with respect to a rotational center of each of the first blowing fan 51*h* and the second blowing fan 52*h*, and arranged to be vertically spaced apart from each other.

A first suction port 31*h*, a second suction port 32*h*, a first discharge port 41*h*, and a second discharge port 42*h* may be provided so as to correspond to this, and each of suction ports 30*h* and each of discharge ports 40*h* may be arranged to cross each other, so that the first discharge air 410*h* and the second discharge air 420*h* may be prevented from interfering with each other.

Hereinafter, an air conditioner 10*i* according to a 9th embodiment of the present invention will be described.

Repeated description with respect to the above-described embodiments will be omitted. In the 9th embodiment unlike the first embodiment, the end of each reference numeral is given as "i".

FIG. 9 is a perspective view showing an air conditioner according to a 9th embodiment of the present invention.

In the present embodiment, structures of an evaporator 22*i* and a condenser 24*i* are different from those in the 8th embodiment.

The evaporator 22*i* and the condenser 24*i* may be arranged to have a plane shape, arranged opposite to each other with respect to a rotational center of each of a first blowing fan 51*i* and a second blowing fan 52*i*, and vertically arranged to be spaced apart from each other.

Hereinafter, an air conditioner 10*j* according to a 10th embodiment of the present invention will be described.

Repeated description with respect to the above-described embodiments will be omitted. In the 10th embodiment unlike the first embodiment, the end of each reference numeral is given as "j".

FIG. 10 is a perspective view showing an air conditioner according to a 10th embodiment of the present invention.

In the present embodiment, a structure of a blowing fan 50*j* is different from that in the 8th embodiment.

In the 8th embodiment, the first blowing fan 51*h* and the second blowing fan 52*h* are provided to be rotated together using a single motor, but in the present embodiment, each of a first blowing fan 51*j* and a second blowing fan 52*j* may be operated using its own motor.

A first suction port 31*j* may be provided in a left panel 12*j*, and a first discharge port 41*j* may be provided in a right panel 13*j*. In contrast, a second suction port 32*j* may be provided in the right panel 13*j*, and a second discharge port 42*j* may be provided in the left panel 12*j*.

Hereinafter, an air conditioner 10*k* according to an 11th embodiment of the present invention will be described.

Repeated description with respect to the above-described embodiments will be omitted. In the 11th embodiment unlike the first embodiment, the end of each reference numeral is given as "k".

FIG. 11 is a perspective view showing an air conditioner according to an 11th embodiment of the present invention.

A main body 11*k* includes a left panel 12*k*, a right panel 13*k*, a rear panel 15*k*, and a front panel 14*k*. In addition, the main body 11*k* includes a discharge main body 63*k* that is provided in an upper portion of the main body 11*k* and formed into a disc shape so as to encircle a blowing fan 50*k*. The discharge main body 63*k* may be included in a first main body 110*k*.

A first suction port 31*k* and a second suction port 32*k* may be provided on the left panel 12*k*. In the present embodiment, the first main body 110*k* may be provided in an upper portion of the main body 11*k* and a second main body 120*k* is provided in a lower portion thereof, and therefore the first suction port 31*k* may be provided in an upper portion of the left panel 12*k* and the second suction port 32*k* may be provided in a lower portion thereof.

The first main body 110*k* may include the discharge main body 63*k*.

A first blowing fan 51*k* may be disposed inside the discharge main body 63*k*. The first blowing fan 51*k* may be disposed side by side with a support surface on which the main body 11*k* is supported, and discharge air heat-exchanged with an evaporator 22*k* in a direction parallel to the support surface. The discharge main body 63*k* may be formed into a substantially disc shape.

A first discharge port 41*k* may be provided in the discharge main body 63*k*, and a second discharge port 42*k* may be provided in the rear panel 15*k*. The first discharge port 41*k* may be provided to have an arc shape along a circumference of the discharge main body 63*k*. Through this shape, air discharged from the first discharge port 41*k* may be discharged in a planar direction parallel to the support surface.

The evaporator 22*k* may be provided inside the first main body 110*k*, and air passing through the evaporator 22*k* flows upward and is discharged to a front side of the main body 11*k* by the first discharge port 41*k* provided on a front side of the discharge main body 63*k* by a sirocco fan that is the first blowing fan 51*k*.

A condenser 24*k* may be provided inside the second main body 120*k*, and air passing through the condenser 24*k* flows rearward and is discharged to a rear side of the main body 11*k* by the second discharge port 42*k* provided in the rear panel 15*k* by the sirocco fan that is a second blowing fan 52*k*. That is, the second blowing fan 52*k* may discharge air heat-exchanged with the condenser in a direction different from an air discharge direction by the first blowing fan 51*k*.

Hereinafter, an air conditioner 10*l* according to a 12th embodiment of the present invention will be described.

Repeated description with respect to the above-described embodiments will be omitted. In the 12th embodiment unlike the first embodiment, the end of each reference numeral is given as "l".

FIG. 12 is a perspective view showing an air conditioner according to a 12th embodiment of the present invention.

A main body 11*l* may be provided to have a hemispherical shape. Specifically, the main body 11*l* may include a circular flat panel 70*l* provided to be flat and a curved panel 71*l* formed into a hemispherical curved surface.

The main body 11*l* may include a first main body 110*l* and a second main body 120*l*.

The first main body 110*l* and the second main body 120*l* may be arranged to form a half of the hemispherical shape from the hemispherical main body 11*l*.

In the present embodiment, a first suction port 31*l*, a second suction port 32*l*, a first discharge port 41*l*, and a second discharge port 42*l* may be provided on the curved panel 71*l*.

An evaporator 22*l* and a condenser 24*l* may be arranged on an inner surface of the curved panel 71*l*, and arranged opposite to each other. The first suction port 31*l* and the second suction port 32*l* may be provided on the curved panel 71*l* to correspond to the evaporator 22*l* and the condenser 24*l*, and arranged opposite to each other. However, the present invention is not limited thereto, and the first suction port 31*l* and the second suction port 32*l* may be arranged any one of the curved panel 71*l* and the flat panel 70*l*.

The first discharge port 41*l* and the second discharge port 42*l* may be arranged opposite to each other between the first suction port 31*l* and the second suction port 32*l*. In other words, the first discharge port 41*l* and the second discharge port 42*l* may be arranged opposite to each other with respect to a center of the curved panel 71*l*.

A first blowing fan 51*l* and a second blowing fan 52*l* may be arranged inside the evaporator 22*l* and the condenser 24*l*, and respectively discharge air introduced from the first suction port 31*l* and the second suction port 32*l* to the first discharge port 41*l* and the second discharge port 42*l* arranged between the first suction port 31*l* and the second suction port 32*l* by converting a flow path of the air introduced from the first suction port 31*l* and the second suction port 32*l*. Both the first blowing fan 51*l* and the second blowing fan 52*l* may be applicable as a sirocco fan.

Hereinafter, an air conditioner 10*m* according to a 13th embodiment of the present invention will be described.

Repeated description with respect to the above-described embodiments will be omitted. In the 13th embodiment unlike the first embodiment, the end of each reference numeral is given as "m".

FIG. 13 is a perspective view showing an air conditioner according to a 13th embodiment of the present invention.

In the present embodiment, arrangement of the air conditioner 10*m*, an evaporator 22*m*, a condenser 24*m*, a blowing fan 50*m*, a suction port 30*m*, and a discharge port 40*m* is different from that in the 12th embodiment.

A flat panel 70*m* is disposed to be inclined at a predetermined angle with respect to a bottom surface on which a main body 11*m* is supported, and a curved panel 71*m* may be provided to be supported by the bottom surface.

The condenser 24*m* is disposed to be perpendicular to the bottom surface. The evaporator 22*m* may be disposed on an inner surface of the flat panel 70*m* so as to be side by side with the flat panel 70*m*. A first suction port 31*m* may be provided on the flat panel 70*m*, so that air may be introduced into the evaporator 22*m* through the first suction port 31*m*. A second suction port 32*m* may be provided on the curved panel 71*m*, so that air may be introduced into the condenser 24*m*.

A first discharge port 41*m* may be provided on the curved panel 71*m*, and provided in an upper portion of the main body 11*m*. Through this, air introduced into the flat panel 70*m* may be discharged to the upper portion of the main body 11*m* via the evaporator 22*m*. A second discharge port 42*m* may be provided on the curved panel 71*m*, and provided on a side portion of the main body 11*m*. Both a first blowing fan 51*m* and a second blowing fan 52*m* may be applicable as a sirocco fan.

Hereinafter, an air conditioner 10*n* according to a 14th embodiment of the present invention will be described.

Repeated description with respect to the above-described embodiments will be omitted. In the 14th embodiment unlike the first embodiment, the end of each reference numeral is given as "n".

FIG. 14 is a perspective view showing an air conditioner according to a 14th embodiment of the present invention.

A main body 11*n* may be provided to have a triangular prism shape while having a substantially triangular cross-section.

The main body 11*n* may include an upper panel 16*n*, a lower panel 17*n*, and a plurality of side panels 12*n*.

The main body 11*n* may be provided to have a triangular prism shape, and therefore the number of the side panels is three. In the present embodiment, the main body 11*n* is formed into a triangular prism shape with a triangular cross-section, but is not limited thereto, and the main body 11*n* may be formed into a polyprism shape with a polygonal cross-section.

An evaporator 22*n* and a condenser 24*n* may be vertically arranged on any one of the plurality of side panels 12*n*. That is, the evaporator 22*n* may be disposed in an upper portion of the side panel and the condenser 24*n* may be disposed in a lower portion thereof. To correspond to the evaporator 22*n* and the condenser 24*n*, a first suction port 31*n* and a second suction port 32*n* may be vertically arranged on the side panel 12*n*.

A first discharge port 41*n* and a second discharge port 42*n* may be arranged on the remaining plurality of side panels 12*n* excluding the side panel on which the evaporator 22*n* and the condenser 24*n* are arranged among the plurality of side panels 12*n*. In the present embodiment, the first suction port 31*n* and the second suction port 32*n* are arranged on one of three side panels 12*n*, the first discharge port 41*n* is disposed on another one thereof, and the second discharge port 42*n* is disposed on still another one thereof.

Both a first blowing fan 51*n* and a second blowing fan (not shown) may be used as a cross-flow fan, and the first blowing fan 51*n* and the second blowing fan may be vertically arranged side by side to change a flow path direction of air introduced from the first suction port 31*n* and the second suction port 32*n*.

Hereinafter, an air conditioner 10*o* according to a 15th embodiment of the present invention will be described.

Repeated description with respect to the above-described embodiments will be omitted. In the 15th embodiment unlike the first embodiment, the end of each reference numeral is given as "o".

FIG. 15 is a perspective view showing an air conditioner according to a 15th embodiment of the present invention.

In the present embodiment, arrangement of internal components of an air conditioner and a main body is different from that in the 14th embodiment.

A main body 11*o* includes a first main body 110*o* provided in an upper portion thereof and a second main body 120*o* provided in a lower portion thereof.

A first discharge port 41*o* and a second suction port 32*o* may be arranged in any one of a plurality of side panels 12*o*, and a second discharge port 42*o* and a first suction port 31*o* may be arranged in another one thereof.

Both a first blowing fan 51*o* and a second blowing fan 52*o* may be used as a sirocco fan and vertically arranged side by side, so that a flow path direction of air introduced from the first suction port 31*o* and the second suction port 32*o* may be changed.

Hereinafter, an air conditioner 10*p* according to a 16th embodiment of the present invention will be described.

Repeated description with respect to the above-described embodiments will be omitted. In the 16th embodiment unlike the first embodiment, the end of each reference numeral is given as "p".

FIG. 16 is a perspective view showing an air conditioner according to a 16th embodiment of the present invention.

A main body 11*p* may be provided to have a cylinder shape. The main body 11*p* includes an upper panel 16*p*, a lower panel 17*p*, and a side panel 12*p* that connects the upper panel 16*p* and the lower panel 17*p*.

Inside the main body 11*p*, an evaporator 22*p* and a condenser 24*p* may be arranged to face each other. That is, the evaporator 22*p* and the condenser 24*p* may be arranged on an inner side of the side panel, and arranged opposite to each other. A first suction port 31*p* and a second suction port 32*p* may be arranged on the side panel so as to correspond to the evaporator 22*p* and the condenser 24*p*.

A first blowing fan 51*p* and a second blowing fan 52*p* may arranged between the evaporator 22*p* and the condenser 24*p*, and a sirocco fan may be applicable in order to change a flow path. A first discharge port 41*p* and a second discharge port 42*p* may be provided on the side panel so that air introduced through the first suction port 31*p* and the second suction port 32*p* may be discharged in a direction perpendicular to a center of the main body 11*p*. That is, the air is sucked in a right and left direction of the main body 11*p* and discharged in a front and back direction.

The first blowing fan 51*p* and the second blowing fan 52*p* may be provided to be rotated using a single motor.

Hereinafter, an air conditioner 10*q* according to a 17th embodiment of the present invention will be described.

Repeated description with respect to the above-described embodiments will be omitted. In the 17th embodiment unlike the first embodiment, the end of each reference numeral is given as "q".

FIG. 17 is a perspective view showing an air conditioner according to a 17th embodiment of the present invention.

A main body 11*q* includes a first main body 110*q* in which an evaporator 22*q* is disposed and a second main body 120*q* in which a condenser 24*q* is disposed.

The first main body 110*q* and the second main body 120*q* may be provided so as to be spaced apart from each other, and connected to each other through a pipe. Movement of a refrigerant between the first main body 110*q* and the second main body 120*q* may be carried out through a pipe 75*q*.

In the first main body 110*q*, the evaporator 22*q* and a first blowing fan 51*q* may be arranged, and in the second main body 120*q*, the condenser 24*q* and a second blowing fan 52*q* may be arranged.

Through this structure, cooling may be performed through the first main body 110*q*, and heating may be performed through the second main body 120*q*.

Hereinafter, an air conditioner 10*r* according to an 18th embodiment of the present invention will be described.

Repeated description with respect to the above-described embodiments will be omitted. In the 18th embodiment unlike the first embodiment, the end of each reference numeral is given as "r".

FIG. 18 is a perspective view showing an air conditioner according to an 18th embodiment of the present invention.

A main body 11*r* includes a first main body 110*r* in which an evaporator 22*r* is disposed and a second main body 120*r* in which a condenser 24*r* is disposed. The first main body 110*r* and the second main body 120*r* may be provided to have different shapes from each other, and provided adjacent to each other.

In the first main body 110*r*, the evaporator 22*r* and a first blowing fan 51*r* may be arranged, and in the second main body 120*r*, the condenser 24*r* and a second blowing fan 52*r* may be disposed.

Through this structure, cooling may be performed through the first main body 110*r* and heating may be performed through the second main body 120*r*.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. An air conditioner comprising:

a mounting base provided on a support surface;

a main body separated from the support surface by the mounting base, the main body including:

a lower panel supported by the mounting base, a compressor configured to compress a refrigerant, a condenser configured to condense the refrigerant into a liquid phase, and an evaporator configured to evaporate the refrigerant by exchanging heat between the refrigerant and external air; and a first suction port and a second suction port provided on the lower panel and separated from the support surface by the mounting base and configured to allow the external air into the main body, wherein the condenser is arranged on the first suction port within the main body and the evaporator is arranged on the second suction port within the main body.

2. The air conditioner of claim 1, wherein the condenser and the evaporator are positioned on the same plane within the main body.

3. The air conditioner of claim 1, wherein each of the condenser and the evaporator is arranged to be inclined at a predetermined angle with respect to the first suction port and a second suction port within the main body.

4. The air conditioner of claim 1, further comprising:

a first discharge port that is provided in the main body to discharge air heat-exchanged with the condenser to an air-conditioned space; and a second discharge port that is provided in the main body to discharge air heat-exchanged with the evaporator to the air-conditioned space, wherein the first discharge port and the second discharge port are arranged on mutually different surfaces of the main body.

5. The air conditioner of claim 1, wherein a power consumption of the compressor is 300 w or less.

6. The air conditioner of claim 1, wherein the main body is provided to be movable.

7. The air conditioner of claim 1, wherein the main body further includes:

a first main body that has a condensation space in which the condenser is arranged, a second main body that has an evaporation space in which the evaporator is arranged, and a partition separating the first main body and the second main body.

* * * * *